US011225747B2

(12) United States Patent
Khizar et al.

(10) Patent No.: US 11,225,747 B2
(45) Date of Patent: Jan. 18, 2022

(54) APPLIANCE AND COATING FOR SAME

(71) Applicant: WHIRLPOOL CORPORATION, Benton Harbor, MI (US)

(72) Inventors: Muhammad Khizar, Saint Joseph, MI (US); Ermanno Buzzi, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 207 days.

(21) Appl. No.: 16/273,697

(22) Filed: Feb. 12, 2019

(65) Prior Publication Data

US 2020/0255939 A1 Aug. 13, 2020

(51) Int. Cl.

| | |
|---|---|
| ***D06F 37/02*** | (2006.01) |
| ***D06F 21/08*** | (2006.01) |
| ***D06F 37/26*** | (2006.01) |
| ***D06F 39/14*** | (2006.01) |
| ***D06F 58/20*** | (2006.01) |
| *D06F 39/02* | (2006.01) |
| *D06F 39/08* | (2006.01) |

(52) U.S. Cl.

CPC ..... *D06F 37/02* (2013.01); *D06F 21/08* (2013.01); *D06F 37/26* (2013.01); *D06F 39/14* (2013.01); *D06F 58/20* (2013.01); *D06F 39/02* (2013.01); *D06F 39/083* (2013.01); *D06F 39/088* (2013.01)

(58) Field of Classification Search

CPC ..... D06F 21/08; D06F 37/02; D06F 37/026; D06F 39/02; D06F 39/14; D06F 39/083; D06F 39/088; D06F 58/20

See application file for complete search history.

(56) References Cited

U.S. PATENT DOCUMENTS

| | | | | |
|---|---|---|---|---|
| 6,294,258 | B1 | 9/2001 | Gentile | |
| 9,750,390 | B2 | 9/2017 | Flores et al. | |
| 2014/0011013 | A1* | 1/2014 | Jin | H01L 31/02366 428/297.4 |
| 2014/0201929 | A1 | 7/2014 | He et al. | |
| 2016/0257823 | A1* | 9/2016 | Amano | B29C 48/0018 |
| 2017/0037558 | A1* | 2/2017 | Dunsbergen | D06F 39/02 |
| 2017/0240752 | A1 | 8/2017 | Banerjee et al. | |
| 2017/0303764 | A1 | 10/2017 | Flores et al. | |
| 2019/0264368 | A1* | 8/2019 | Kim | D06F 35/008 |

FOREIGN PATENT DOCUMENTS

| | | | | |
|---|---|---|---|---|
| DE | 102012223682 | A1 * | 6/2014 | D06F 37/261 |
| EP | 1582136 | B1 | 8/2006 | |
| EP | 2868794 | A1 | 5/2015 | |
| EP | 3290576 | A1 | 3/2018 | |

(Continued)

OTHER PUBLICATIONS

Machine translation of DE-102012223682-A1 to Schaub et al. (Year: 2014).*

(Continued)

*Primary Examiner* — Joseph L. Perrin
(74) *Attorney, Agent, or Firm* — McGarry Bair PC

(57) ABSTRACT

A household appliance can include a treating chamber configured to receive an article for treatment according to a cycle of operation of the household appliance, as well as a coating on at least a portion of the treating chamber. The coating can be configured to provide at least hydrophobicity characteristics to the treating chamber.

20 Claims, 5 Drawing Sheets

(56) References Cited

FOREIGN PATENT DOCUMENTS

| | | | |
|---|---|---|---|
| GB | 2511360 | A | 9/2014 |
| WO | 2013060602 | A2 | 5/2013 |

OTHER PUBLICATIONS

Cataldi et al: "A Thermochromic Superhydrophobic Surface", Scientific Reports, vol. 6, No. 1, Jun. 1, 2016 . (Year: 2016).*
Granqvist et al.: "Transparent conductors as solar energy materials: A panoramic review", Solar Energy Materials and Solar Cells, Elsevier Science Publishers, Amsterdam, NL, vol. 91, No. 17, Oct. 15, 2007. (Year: 2007).*
Chen et al., "Strong and super-hydrophobic hybrid carbon nanotube films with superior loading capacity", Carbon, vol. 137, Oct. 2018, pp. 88-92. (Year: 2018).*

* cited by examiner

APPLIANCE AND COATING FOR SAME

BACKGROUND

Conventional household appliances, such as laundry washing or drying machines, dishwashers, and the like, can involve the application of heat during an operation cycle to improve cleaning performance. Factors such as an amount of heat applied or a time duration during which heat is applied can be customized for a variety of operation cycles for cleaning. Such appliances can include a device that indicates an operating temperature to a user during a cleaning cycle.

BRIEF SUMMARY

In one aspect, the disclosure relates to a household appliance. The household appliance includes a treating chamber configured to receive an article for treatment according to an automatic cycle of operation of the household appliance, and a coating on at least a portion of the treating chamber, the coating configured to provide at least hydrophobicity characteristics and reversible thermochromic characteristics to the at least a portion of the treating chamber.

DETAILED DESCRIPTION

Figure 1:
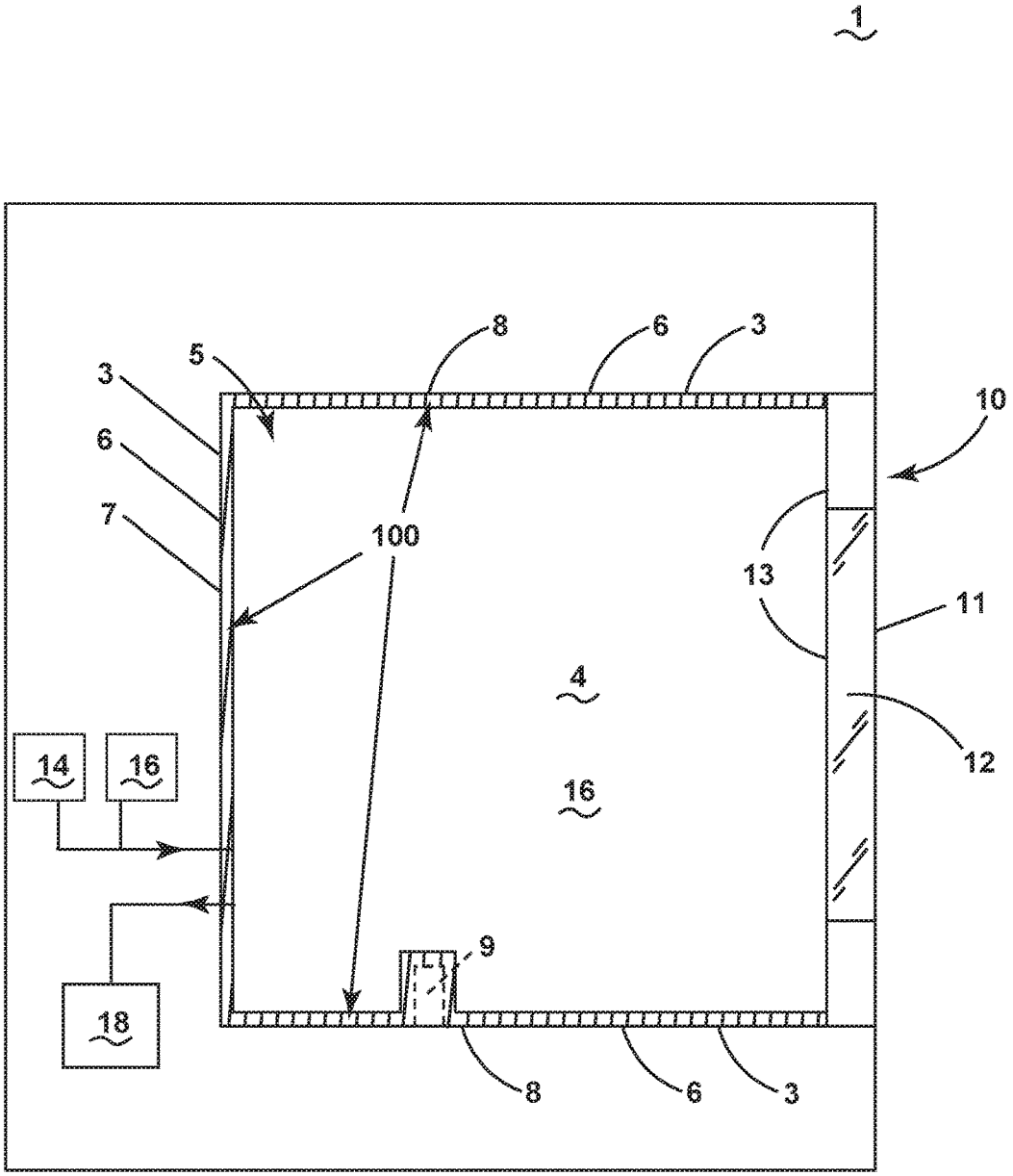
FIG. 1 is a schematic cross-sectional view of an exemplary household appliance with a coating in accordance with various aspects described herein.

FIG. 1 is a schematic illustration of a household appliance 1, which will not be described in detail except as necessary for a complete understanding of the disclosure. It should be understood that the household appliance 1 can include a clothes washer, a clothes dryer, or dishwasher, and that the various aspects in the present disclosure can be used in any suitable household appliance, including a vertical-axis clothes washer, horizontal-axis clothes washer, combination washer-dryer, freestanding dishwasher, or under-counter dishwasher, in non-limiting examples.

The household appliance 1 can include a treating chamber 2 with at least one treating chamber surface 3. The treating chamber 2 can receive an article, such as dishes or laundry in non-limiting examples, for treatment according to a cycle of operation of the household appliance 1.

The household appliance 1 can include an interior 4 defined by a drum 5 having at least one inside surface 6 and forming the treating chamber 2, where the at least one treating chamber surface 3 defines the at least one inside surface 6. For example, the inside surface 6 can further include a back wall 7 and a circumferential wall 8 that defines an interior circumference of the drum 5.

The drum 5 can also include additional components that form the at least one treating chamber surface 3. For example, an interior surface or feature 9 is schematically illustrated in dashed line. In one example, the interior feature 9 can be a baffle extending inwardly from the inside surface 6 of the drum 5. In another example, the interior feature 9 can be a depression in the inside surface 6. In still another example, the interior feature 9 can be a "bump" or surface protrusion along the inside surface 6. It should also be understood that while a single interior feature 9 is illustrated, multiple interior features 9 can be included and form the at least one treating chamber surface 3, such as multiple baffles spaced around the drum, or multiple depressions in the inside surface forming a predetermined pattern along the treating chamber 2.

A closure 10 can be provided to selectively open and close the drum 5 while also providing access to the treating chamber 2 for the loading and unloading of articles being treated. In the illustrated example, the closure 10 is in the form of a door 11 that can include a transparent window 12. The door 11 can also include an inner surface 13 that at least partially defines the treating chamber 2. In this manner the treating chamber 2 can be defined at least by the back wall 7 and circumferential wall 8 of the drum 5, as well as the inner surface 13 of the door 11. It is also contemplated that the closure 10 can include multiple doors or access panels that can be transparent or opaque.

While the treating chamber 2 is illustrated as being defined within the drum 5, it is contemplated that other components of the household appliance 1 can define the treating chamber 2. In one non-limiting example, a household appliance can include an upright tub with side walls and a bottom wall that at least partially defines the treating chamber, and a lid can form a top closure for the treating chamber. In another non-limiting example, a household appliance can include stationary interior walls that at least partially define the treating chamber, and a door can form a closure for the treating chamber. In still another non-limiting example, a household appliance can include a top-loading drum that rotates about a horizontal axis, where the drum includes a front wall and a back wall connected by a circumferential wall.

The household appliance 1 can also include a fluid delivery system 14 in fluid communication with the interior 4 of the drum 5 and configured to provide or supply a fluid to the drum 5 during a cycle of operation. In non-limiting examples, the fluid delivery system 14 can include a water supply, an air supply, a sprayer, an injector, a nebulizer, a pump, a steam generator, a fan, a heater, or the like, or combinations thereof. At least one treating chemistry dispenser 16 can also be provided and in fluid communication with either or both of the drum 5 and fluid delivery system 14. The household appliance 1 can further include a fluid removal system 18 in fluid communication with the interior 4 and configured to remove fluid from the interior 4 during a cycle of operation. In non-limiting examples, the fluid removal system 18 can include a liquid pump, a vacuum system, a heater, a constant-speed fan, a variable-speed fan, an air compressor, an air source, an air tank, an air pump, a condenser system, a desiccant system, a steam drying system, an electrostatic drying system, a microwave drying system, a conduction drying system, or a convection drying system, or the like, or combinations thereof.

The household appliance 1 can also include additional components (not shown) such as a sump, rack, agitator, impeller, reuse tank, recirculation pump, filtration system, stabilization system, or user interface, as well as suitable conduits, valves, and electrical connections as are known in the art. Such components will not be further described except where necessary for a full understanding of the disclosure.

A coating 100 can also be included on at least a portion of the treating chamber 2, such as on the at least one treating chamber surface 3. In the illustrated example, the coating 100 is on the entire inside surface 6 of the drum. It should be understood that the coating 100 can be included on any or all of the back wall 7, circumferential wall 8, or interior feature 9, including a baffle, depression, dimple, or other surface feature as described above. In addition, the coating 100 can be provided over the entire treating chamber surface 3 or any portion thereof.

Figure 2:
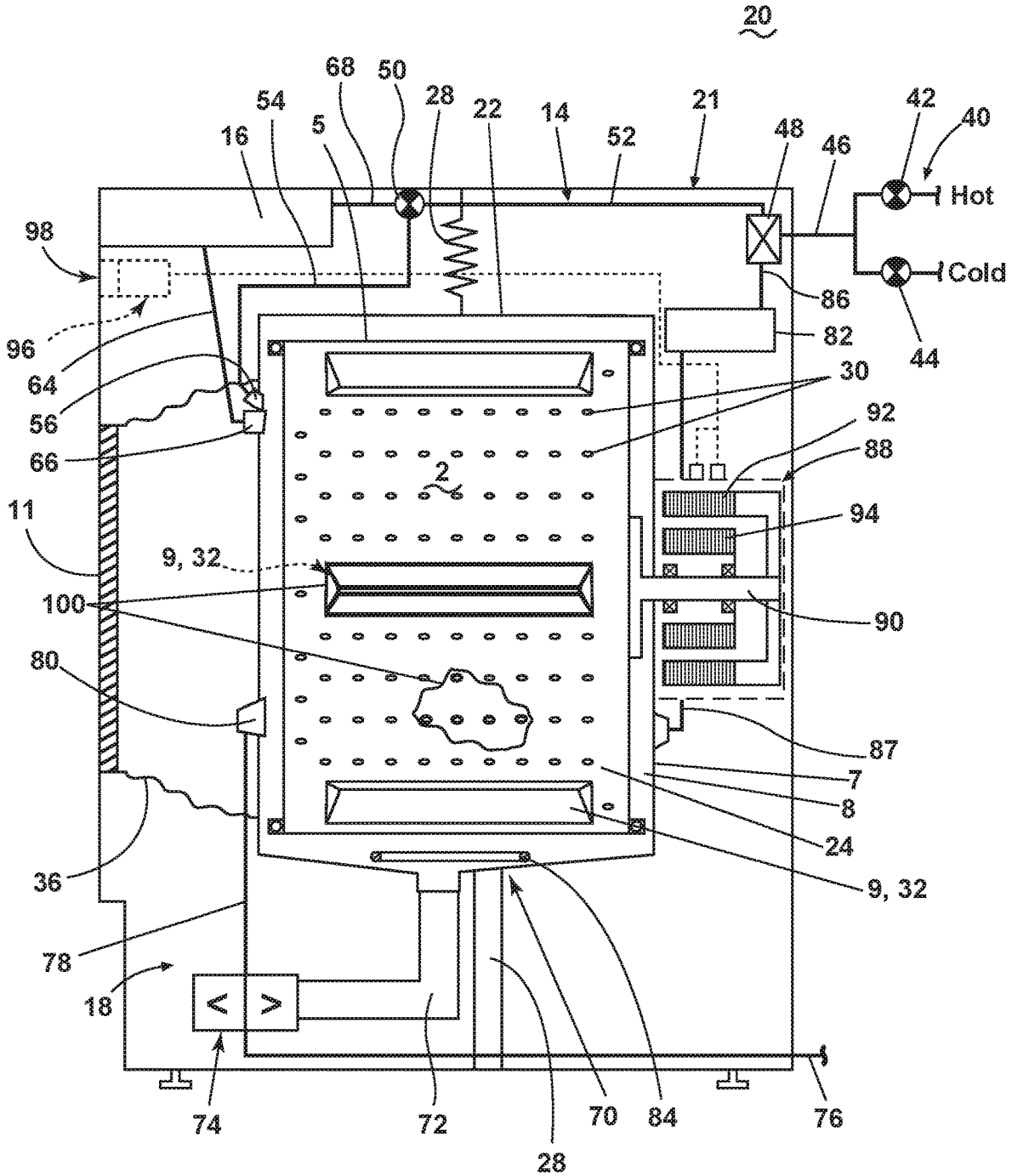
FIG. 2 is a schematic cross-sectional view of the exemplary household appliance of FIG. 1 in the form of a laundry treating appliance including the coating of FIG. 1.

Turning to FIG. 2, one example of the household appliance 1 is illustrated in the form of a laundry treating appliance 20, such as a horizontal axis washing machine. The laundry treating appliance 20 can include any or all of the components described in FIG. 1.

The laundry treating appliance 20 can include a structural support system comprising a cabinet 21 which defines a housing within which a laundry holding system resides. The cabinet 21 can be a housing having a chassis and/or a frame, to which decorative panels can or cannot be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system comprises a tub 22 dynamically suspended within the structural support system of the cabinet 21 by a suitable suspension system 28. The drum 5 can be provided within the tub 22 and define at least a portion of the laundry treating chamber 2. In the illustrated example, the drum 5 is configured to receive a laundry load comprising articles for treatment, including, but not limited to, hats, scarves, gloves, sweaters, blouses, shirts, shorts, dresses, socks, pants, shoes, undergarments, or jackets. The drum 5 can include a plurality of perforations 30 such that liquid can flow between the tub 22 and the drum 5 through the perforations 30. It is also within the scope of the present disclosure for the laundry holding system to comprise only one receptacle with the receptacle defining the laundry treating chamber for receiving the load to be treated.

At least one interior feature 9 in the form of a lifter 32 may be provided in the drum 5 to facilitate movement of the laundry load within the drum 5 as the drum 5 rotates. The lifter 32 may be provided on the inner periphery of the drum 5. Multiple lifters 32 may be provided and may optionally be evenly spaced about the inner periphery of the drum 5.

The coating 100 can be included over interior surfaces of the laundry treating appliance 20. In the illustrated example, the coating 100 is illustrated as fully covering one lifter 32 as indicated in bold line, as well as over a portion of an inside surface 24 of the tub 22 as indicated in bold line. It is contemplated that the coating 100 can be provided over any portion, including the entirety, of the tub 22, drum 5, lifters 32, and any other interior features 9 as described above.

The laundry holding system can further include the door 11 which can be movably mounted to the cabinet 21 to selectively close both the tub 22 and the drum 5. A bellows 36 can couple an open face of the tub 22 with the cabinet 21, with the door 11 sealing against the bellows 36 when the door 11 closes the tub 22.

The laundry treating appliance 20 can further include the fluid delivery system 14 in the form of a liquid supply system for supplying water to the laundry treating appliance 20 for use in treating laundry during a cycle of operation. The fluid delivery system 14 can include a source of water, such as a household water supply 40, which can include separate valves 42 and 44 for controlling the flow of hot and cold water, respectively. Water can be supplied through an inlet conduit 46 directly to the tub 22 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 22. In this manner, water from the household water supply 40 can be supplied directly to the tub 22. While the valves 42, 44 and the conduit 46 are illustrated exteriorly of the cabinet 21, it will be understood that these components can be internal to the cabinet 21.

The laundry treating appliance 20 can also be provided with a dispensing system for dispensing treating chemistry to the treating chamber 2 for use in treating the laundry according to a cycle of operation. The dispensing system can include the treating chemistry dispenser 16 which can be a single dose dispenser, a bulk dispenser, or an integrated single dose and bulk dispenser and is fluidly coupled to the treating chamber 2. The treating chemistry dispenser 16 can be configured to dispense a treating chemistry directly to the tub 22 or mixed with water from the liquid supply system through a dispensing outlet conduit 64. The dispensing outlet conduit 64 can include a dispensing nozzle 66 configured to dispense the treating chemistry into the tub 22 in a desired pattern and under a desired amount of pressure. For example, the dispensing nozzle 66 can be configured to dispense a flow or stream of treating chemistry into the tub 22 by gravity, i.e. a non-pressurized stream. Water can be supplied to the treating chemistry dispenser 16 from the supply conduit 52 by directing the second diverter mechanism 50 to direct the flow of water to a dispensing supply conduit 68.

The treating chemistry dispenser 16 can include multiple chambers or reservoirs for receiving doses of different treating chemistries. The treating chemistry dispenser 16 can be implemented as a dispensing drawer that is slidably received within the cabinet 21, or within a separate dispenser housing which can be provided in the cabinet 21. The treating chemistry dispenser 16 can be movable between a fill position, where the treating chemistry dispenser 16 is exterior to the cabinet 21 and can be filled with treating chemistry, and a dispense position, where the treating chemistry dispenser 16 are interior of the cabinet 21.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 20 can also include the fluid removal system 18 in the form of a recirculation and drain system for recirculating liquid within the laundry holding system and draining liquid from the laundry treating appliance 20. Liquid supplied to the tub 22 through tub outlet conduit 54 and/or the dispensing supply conduit 68 typically enters a space between the tub 22 and the drum 5 and can flow by gravity to a sump 70 formed in part by a lower portion of the tub 22. The sump 70 can also be formed by a sump conduit 72 that can fluidly couple the lower portion of the tub 22 to a pump 74. The pump 74 can direct liquid to a drain conduit 76, which can drain the liquid from the laundry treating appliance 20, or to a recirculation conduit 78, which can terminate at a recirculation inlet 80. The recirculation inlet 80 can direct the liquid from the recirculation conduit 78 into the drum 5. The recirculation inlet 80 can introduce the liquid into the drum 5 in any suitable manner, such as by spraying, dripping, or providing a steady flow of liquid. In this manner, liquid provided to the tub 22, with or without treating chemistry can be recirculated into the treating chamber 2 for treating the laundry within.

The fluid supply system 14 or fluid removal system 18 can be provided with a heating system which can include one or more devices for heating laundry and/or liquid supplied to the tub 22, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 22 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 22 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the laundry treating appliance 20 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The laundry treating appliance 20 also includes a drive system for rotating the drum 5 within the tub 22. The drive system can include a motor 88, which can be directly coupled with the drum 5 through a drive shaft 90 to rotate the drum 5 about a rotational axis during a cycle of operation. The motor 88 can be a brushless permanent magnet (BPM) motor having a stator 92 and a rotor 94. Alternately, the motor 88 can be coupled to the drum 5 through a belt and a drive shaft to rotate the drum 5, as is known in the art. Other motors, such as an induction motor or a permanent split capacitor (PSC) motor, can also be used. The motor 88 can rotate the drum 5 at various speeds in either rotational direction.

The laundry treating appliance 20 also includes a control system for controlling the operation of the laundry treating appliance 20 to implement one or more cycles of operation. The control system can include a controller 96 located within the cabinet 21 and a user interface 98 that is operably coupled with the controller 96. The user interface 98 can include one or more knobs, dials, switches, displays, touch screens and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the laundry treating appliance 20. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 3:
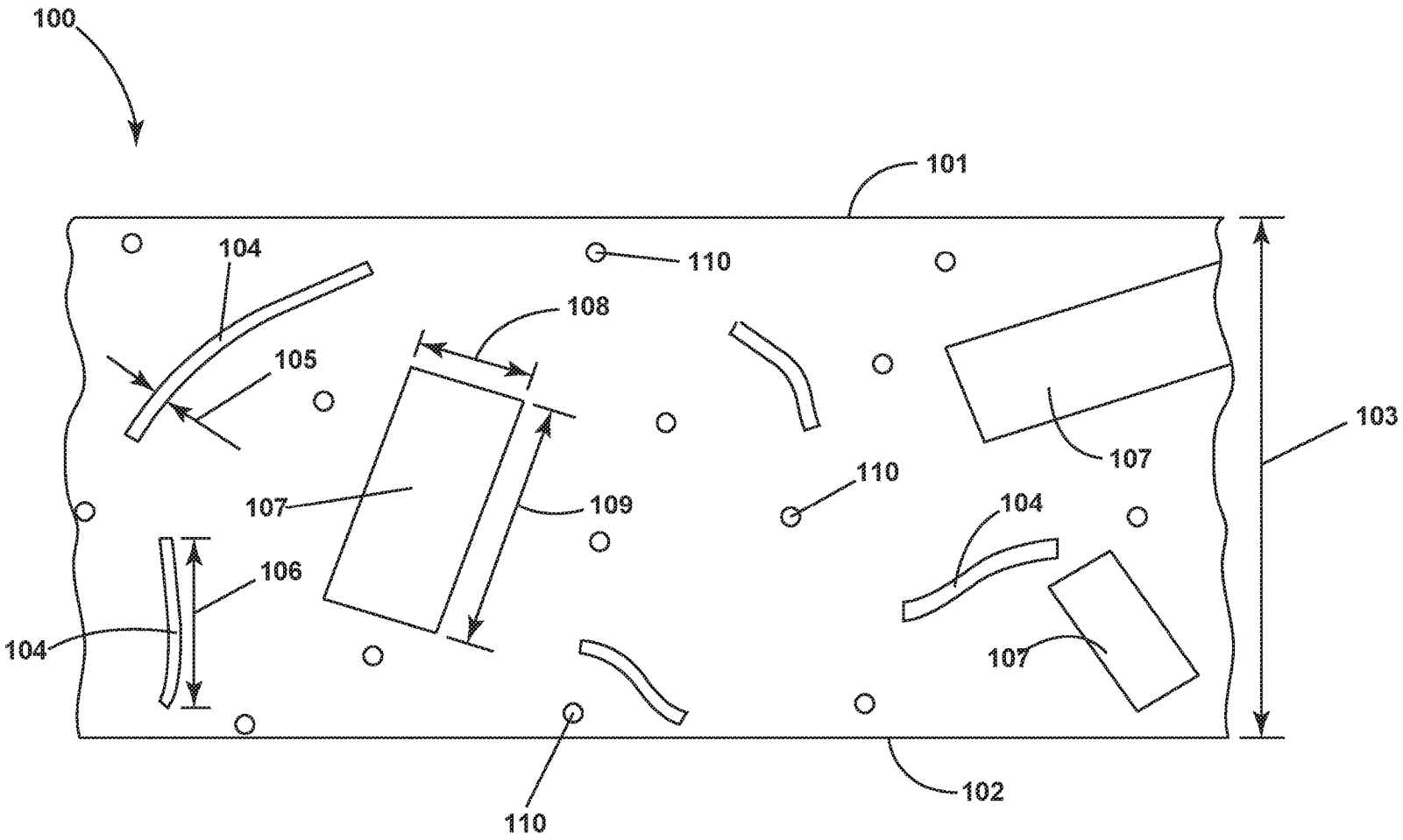
FIG. 3 is a schematic side view of the coating of FIG. 1.

Turning to FIG. 3, the coating 100 is illustrated in further detail. The coating 100 can include a first surface 101 spaced from a second surface 102, and a coating thickness 103 can be defined between the first and second surfaces 101, 102. Either of the first or second surfaces 101, 102 can be adjacent the treating chamber surface 3 (FIG. 1). It is contemplated that the coating 100 can be a thin film, where the coating thickness 103 can be 700 μm thick or smaller in a non-limiting example. Alternately, the coating 100 can have a coating thickness 103 that is greater than 700 μm, including up to 1-2 mm in another non-limiting example, thereby forming a coating that is not a thin film.

It is contemplated that the coating 100 can be a composite, including an injection-moldable composite, a sprayable composite, or a screen-printable composite. In the illustrated example the coating 100 is a composite of vanadium dioxide ($VO_2$) nanowires 104, carbon nanotubes 107, and a polymer 110 that can include a two-system based pre-polymerized polymer. The $VO_2$ nanowires 104 can have an average diameter 105 and a length 106. In one non-limiting example, the average diameter 105 can be 65-110 nm and the average length 106 can be 4.5 μm or smaller. The carbon nanotubes 107 can have an average diameter 108 and a length 109. In one non-limiting example, the average diameter 108 can be from 2-40 nm and the length 109 can be from 0.1 nm-1 cm. The carbon nanotubes 107 can also include either or both of single-walled carbon nanotubes or multi-walled carbon nanotubes. It should be understood that the carbon nanotubes 107 are cylindrically-structured arrangements of carbon atoms that can be formed in a variety of ways including single-walled, double-walled, or multiple-walled configurations.

Figure 4:
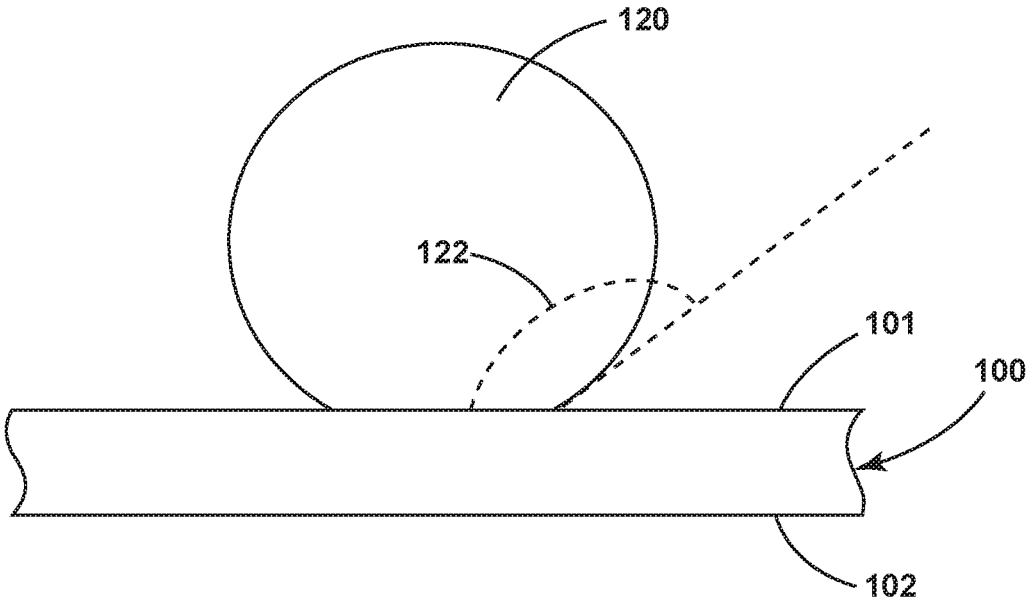
FIG. 4 is a schematic side view of a droplet positioned on the coating of FIG. 1.

Referring now to FIG. 4, the coating 100 is illustrated with a droplet 120 on the first surface 101. The droplet 120 forms a droplet contact angle 122 with the first surface 101 as shown. The droplet 120 can be a water droplet, or a mixture of water and treating chemistry such as detergent or softener, in non-limiting examples. It should be understood that the coating 100 is shown separately from the drum 5 (FIG. 1) for clarity in description of its material properties as described below.

It is contemplated that the coating 100 can have at least one hydrophobicity characteristic, including superhydrophobic. Various measures or degrees of hydrophobicity are known in the art. For example, the coating 100 can be classified as "hydrophobic" if the droplet contact angle 122 is greater than 90 degrees, and classified as "superhydrophobic" if the droplet contact angle 122 is greater than 145 degrees.

Figure 5:
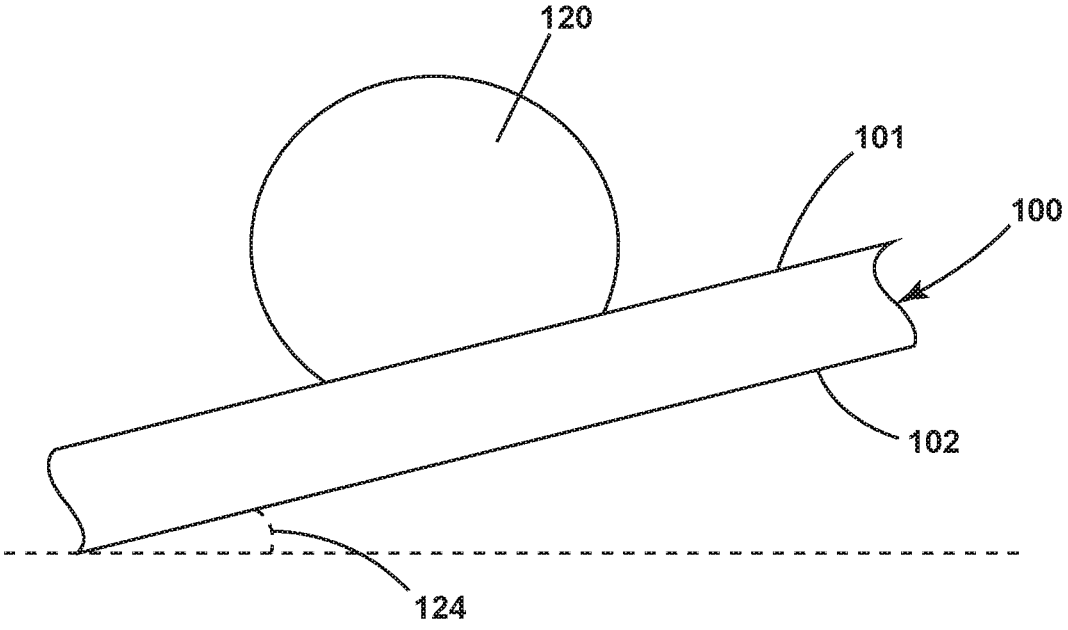
FIG. 5 is a schematic side view of the droplet of FIG. 4 when the coating of FIG. 4 is inclined.

FIG. 5 illustrates the coating 100 with the droplet 120 on the first surface 101. In this example, the coating 100 is inclined or tilted from a horizontal position to a position where the droplet 120 just begins to slide, thereby defining a sliding angle 124 for the coating 100 as shown. While illustrated with respect to the second surface 102, it can be appreciated that the same sliding angle 124 is defined with respect to the first surface 101. In addition, it will be understood that the coating 100 is illustrated in isolation from the drum 5 (FIG. 1), and that the coating 100 is not inclined with respect to the inside surface 6.

The coating 100 can have another hydrophobicity characteristic by way of the sliding angle 124. It can be appreciated that small sliding angles 124 correspond to higher degrees of hydrophobicity. For example, the coating 100 can be superhydrophobic with a sliding angle 124 of at least 2 degrees and a droplet contact angle 122 of at least 145 degrees (FIG. 3). In this manner, the coating 100 can provide at least one hydrophobicity characteristic to at least a portion of the treating chamber 2 when applied to the treating chamber surface 3 (FIG. 1). It can be appreciated that such a superhydrophobic characteristic can provide for increased removal of fluids from the treating chamber 2 (FIG. 1), such as during a draining operation of the laundry treating appliance 20 (FIG. 2), as well as preventing buildup of fluids and treating chemistry on the treating chamber surface 3.

Figure 6:
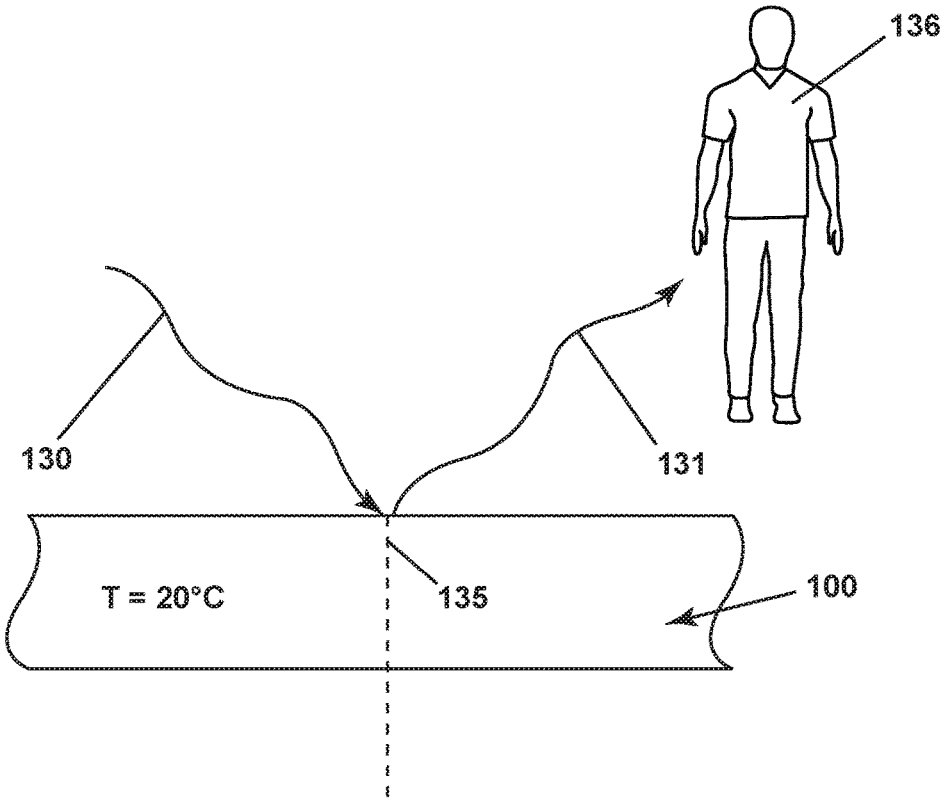
FIG. 6 is a schematic view of one observed color of the coating of FIG. 1.

Turning to FIG. 6, the coating 100 is illustrated when illuminated by incident light 130. A first light wave 131 is emitted from one location 135 along the coating 100 and is observed by a user 136 as shown. The first light wave 131 represents the combination or net effect of any reflected light from the incident light 130 when the user 136 observes the location 135, including any internal reflections and wave interference caused by refraction and reflection within the coating 100 as will be understood by one of ordinary skill in the art. In an example where the coating 100 includes a luminescent or light-emitting property, the first light wave 131 can also represent any light generated by or within the coating 100, including the combination of such generated light with a reflection of incident light on the coating 100.

It is further contemplated that the coating 100 includes at least one type of chromism, or color-changing property. Multiple chromisms are known in the art. In some examples, electrochromic materials can change color when a voltage is applied across the material, thermochromic materials can change color when the material undergoes a temperature change, photochromic materials can change color when irradiated with light, and solvatochromic materials can change color when a solvent is applied to the material.

In the illustrated example, the coating 100 includes a thermochromic characteristic. The coating 100 is at a first temperature, such as 20° C., and the user 136 observes the first light wave 131 to be at a first color, such as yellow.

Figure 7:
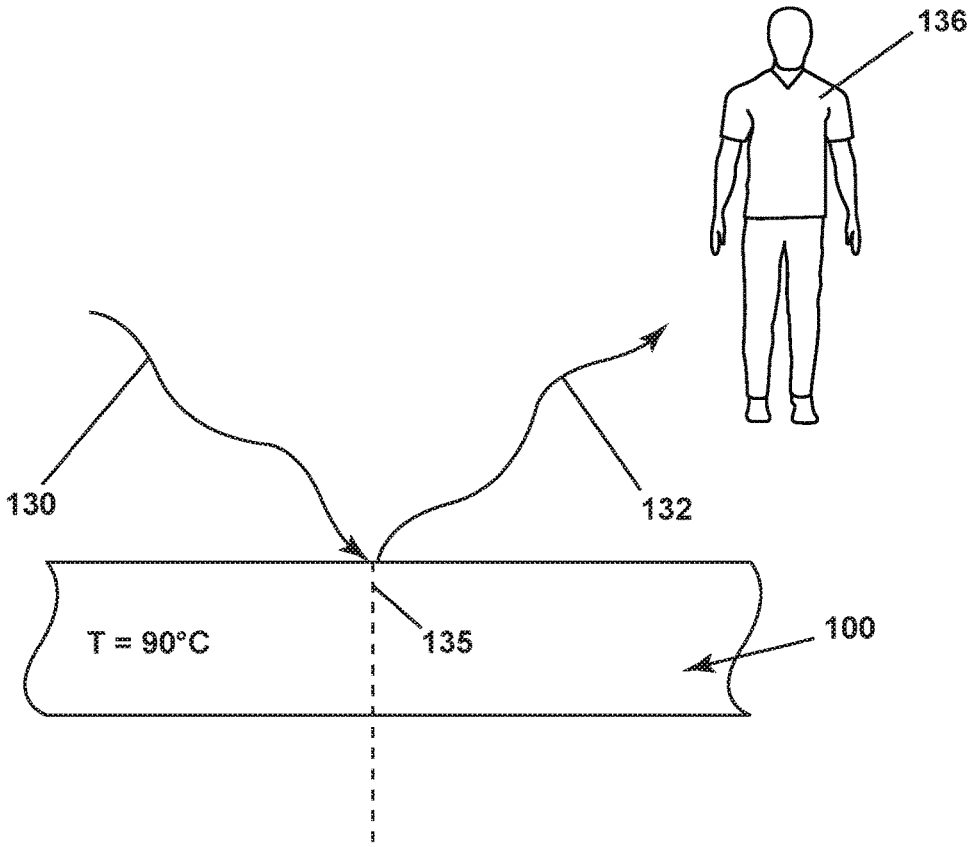
FIG. 7 is a schematic view of another observed color of the coating of FIG. 1.

FIG. 7 illustrates the coating 100 at a second temperature, such as 90° C. The incident light 130 shines toward the coating 100, and the user 136 observes a second light wave 132 from the location 135. In this example, the user 136 observes the second light wave 132 to be a second color, such as orange. It will be understood that the second light wave 132 can represent at least the reflection of the incident light 130, including any intra-film reflections and refractions, as well as any light that may be emitted by the coating 100 itself in an example where the coating 100 includes a light-generating property.

In this manner, the coating 100 can change color when its temperature changes. It is contemplated that the thermochromic characteristic can be reversible, e.g. changing back from orange to yellow if the temperature reduces from 90° C. back to 20° C. in one example. The coating 100 can include at least one transition temperature at which the color change can occur. For example, a color change from yellow to orange can occur at a temperature between 30° C.-250° C. It is also contemplated that multiple color changes can occur. In a non-limiting example, the coating 100 can change blue to yellow within a first temperature zone and from yellow to orange within a second temperature zone higher than the first temperature zone.

During operation of the laundry treating appliance 20 (FIG. 2), liquids and treating chemistry can be supplied to the drum 5 via the fluid delivery system 14 and removed from the drum 5 (e.g. drained) via the fluid removal system 18. Fluid within the drum 5 can cause buildup over time on interior surfaces of the treating chamber 2. Such buildup typically includes fluid left over from a previous cycle of operation, as well as leftover treating chemistry or contaminants from the fluid (e.g. soils from laundry, or minerals from water). The buildup can cause growth of microorganisms within the treating chamber, such as a biofilm, that can contribute to staining of articles, undesirable odors, or reduced operation performance e.g. cleaning performance or drying performance. The hydrophobic coating 100 can aid in removing fluid from the drum 5 during a draining operation, which can prevent buildup from occurring.

In addition, the supplied liquids and treating chemistry can have a high temperature that can cause the coating 100 to change color. For example, the supplied liquid can be from a hot water supply, or a heater within the laundry treating appliance 1 can warm the recirculated liquid to a temperature sufficient to cause a color change in the coating 100. It should also be appreciated that some portions of the treating chamber surface 3 (FIG. 1) can have differing temperatures, such that the coating 100 can have a different observed color over different regions of the treating chamber 2. For example, a user looking through the transparent window 12 of FIG. 1 can observe the circumferential wall 8 to be one color (e.g. yellow) and observe the back wall 7 to be another color (e.g. orange), and be able to discern that the circumferential wall 8 is warmer than the back wall 7. In addition, the user can also discern that the circumferential wall 8 is warmer than a known transition temperature, or has a temperature above a known transition temperature zone, such as being warmer than 250° C. in one example. The coating 100 can therefore provide visual indication to a user regarding an absolute or relative temperature of at least a portion of the treating chamber 2 (FIG. 1). In this manner, the coating 100 can be configured to provide at least hydrophobicity characteristics, including the sliding angle 124 (FIG. 5) and droplet contact angle 122 (FIG. 4), and reversible thermochromic characteristics to at least a portion of the treating chamber 2 (FIG. 1).

One exemplary method of forming the coating 100 will be described below. It should be understood that the coating 100 can be formed in a variety of ways, and that the method described below described one non-limiting example of formation.

The method can include growing vertically-aligned carbon nanotubes in the form of single-walled nanotubes or multi-walled nanotubes, which can be metallic or semiconducting. For example, a "forest" of carbon nanotubes can be grown via a chemical vapor deposition technique. In such a case, platinum can be used as a metallic catalyst through the sintering of a thin film (e.g. 7 nm) of platinum maintained at 650° C. Precursors used during the vapor deposition can include a direct-current (DC) plasma discharge (biased to −650 volts) of acetylene and ammonia, using respective flow rates of 60 and 220 sccm at a partial pressure of 4 Torr. The forest of carbon nanotubes in this process can be grown at a rate of 265 nm/min with a mean diameter of 45 nm and a height of 10-15 μm.

The carbon nanotubes can then be blended with polytetrafluoroethylene via a hot filament chemical process. For example, a resistively-heated hexafluoropropylene oxide gas maintained at 550° C. can be thermally decomposed to form di-fluorocarbene radicals that can polymerize into polytetrofluoroethylene (PTFE). During this process, flow rates of hexafluoropropylene oxide gas and di-fluorocarbene radicals can be maintained at 27 and 10 sccm, respectively, at a pressure of 0.8 Torr. At this stage, the carbon nanotubes and PTFE can be blended into a two-system based pre-polymerized polymer for homogeneous mixing and uniform dispersion. One example of such a pre-polymerized polymer includes 45 durometer, two-part, 10:1 mix, clear, fabric coating grade liquid silicone rubber. For example, the pre-polymerized polymer can have "part A" and "part B" as its two systems mixed at a 10:1 ratio, Meter mix equipment can be utilized to mix the two components without the incorporation of air; the mixture can also be de-gassed under vacuum to remove any entrapped air bubbles. The mixture can cure rapidly at elevated temperatures; for example, a 2 mm cross-section can cure in 8-14 seconds at 200° C. In this manner, a first mixture is formed with the carbon nanotubes and pre-polymerized polymer.

The method can also include blending vanadium dioxide nanowires into a two-system based pre-polymerized polymer, including the liquid silicone rubber mixed as described above, to form a second mixture. The first mixture, containing the carbon nanotubes and pre-polymerized polymer, can then be blended with the second mixture, containing the vanadium dioxide nanowires and pre-polymerized polymer, to form the composite coating with superhydrophobicity and chromogenic properties.

Aspects of the household appliance 1 and coating 100 described herein can be applied to a variety of different household appliances. Some alternate examples will be described below. It should be understood that such examples are given for illustrative purposes only and are not intended to be limiting.

In one example (not shown), the household appliance 1 can be in the form of a laundry dryer. The laundry dryer can include a cabinet defining an interior, and a rotating drum within the interior can define the treating chamber. Articles of clothing can be received within the treating chamber for treatment during a cycle of operation of the laundry dryer.

The laundry dryer can include the fluid delivery system configured to provide warm, low-humidity air to the interior of the rotating drum, as well as a fluid removal system configured to remove moist air from the interior of the drum. Optionally, a treating chemistry dispenser can be provided, such as to provide fragrance or softener to the laundry within the drum.

The coating can be provided over at least a portion of the drum surface, including baffles, lifters, depressions, or surface features that can form the drum surface and treating chamber surface. During operation of the laundry dryer, the hydrophobic coating can aid in removal of moisture from within the drum. In addition, the thermochromic characteristic of the coating provides for a user being able to observe a relative temperature difference between various treating chamber surfaces within the dryer, or an absolute temperature or absolute temperature range of the various treating chamber surfaces, by observing a color change in the coating over those treating chamber surfaces.

In another example (not shown), the household appliance 1 can be in the form of a dishwasher. The dishwasher can include a cabinet defining an interior, and spaced walls within the interior can at least partially define the treating chamber. Dish racks, baskets, or other components can be included within the treating chamber to hold or receive dishes for treatment during a cycle of operation of the dishwasher, and such components can also at least partially define the treating chamber within the dishwasher. A door can be mounted to the cabinet and at least partially define the treating chamber, and the door can selectively provide access to the treating chamber within the dishwasher.

The dishwasher can include a fluid delivery system configured to provide water or treating chemistry to the treating chamber, as well as a fluid removal system configured to remove water or treating chemistry from the treating chamber. The dishwasher can also include a treating chemistry dispenser in fluid communication with the treating chamber, including in fluid communication with the fluid delivery system.

Any or all of the spaced walls, door, dish racks, baskets, rails, mounting hardware, as well as any surface features such as baffles, grooves, or indentations along the spaced walls or door, can include the coating having at least hydrophobicity characteristics and reversible thermochromic characteristics. During operation of the dishwasher, the hydrophobic or superhydrophobic characteristic of the coating can aid in draining fluid from within the dishwasher as well as preventing buildup within the treating chamber, such as buildup on the walls or door. In addition, the thermochromic characteristic of the coating provides for a user being able to observe a relative temperature difference between various treating chamber surfaces within the dishwasher, or an absolute temperature or absolute temperature range of the various treating chamber surfaces, by observing a color change in the coating over those treating chamber surfaces.

In yet another example (not shown), the household appliance 1 can be in the form of a manual washer. The manual washer in this example can include a perforated inner basket nested within a non-perforated outer basket, where the inner and outer baskets at least partially define a treating chamber. The manual washer can include a fluid delivery system configured to provide water or treating chemistry to the treating chamber, such as a hose coupled to a fluid port of the manual washer or a user pouring water into the treating chamber. The manual washer can also include a fluid removal system configured to remove water or treating chemistry from the treating chamber, such as perforations in the basket that provide for water to be expelled from the inner basket to the outer basket. A user can use manual force, such as by repeatedly moving a lever or pressing downward on a shaft provided in the manual washer, to spin the inner basket with respect to the outer basket or agitate laundry placed in the treating chamber.

The coating can be provided on any or all of the surfaces of the inner and outer baskets. During operation of the manual washer, the hydrophobic or superhydrophobic characteristic of the coating can aid in draining or removing fluid from the treating chamber, and the thermochromic characteristic can indicate a relative temperature difference or a temperature of a portion of the treating chamber as described above.

Aspects of the present disclosure provide for a variety of benefits. It can be appreciated that the use of a superhydrophobic coating can improve the performance of a fluid removal system, which can reduce a drying time or a spin operation by removing as much delivered fluid as possible from the articles being treated. In addition, buildup on interior surfaces of the treating chamber can be greatly reduced due to the superhydrophobicity of the treating chamber. As such buildup typically includes fluid left over from a previous cycle of operation, as well as leftover treating chemistry or contaminants from the fluid (e.g. soils from laundry, or minerals from water), the buildup can cause growth of microorganisms within the treating chamber that can contribute to staining of articles, undesirable odors, or reduced operation performance e.g. cleaning performance or drying performance. It can be appreciated that reduction of buildup can prevent such staining or odors, as well as increase cleaning performance.

In addition, the thermochromicity of the coating described herein can provide for quick visual feedback regarding the temperature within the treating chamber. Such information can be useful in a variety of applications. For instance, a user may wish to dry a delicate item in a laundry dryer, and the thermochromic coating can indicate whether the surface temperature in the treating chamber is within, or exceeds, a desired range based on the color change. Alternately, the color-changing property can provide for indication of excessive temperature differences within the treating chamber, e.g. "hot spots" or otherwise non-uniform temperature distribution. In addition, the reversible thermochromicity can provide for indication of a surface temperature in the treating chamber over time, e.g. changing from blue to white, and back to blue, indicating a rising and falling temperature of a surface within the treating chamber during a cycle of operation of the household appliance.

To the extent not already described, the different features and structures of the various embodiments can be used in combination with each other as desired. That one feature is not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the disclosure has been specifically described in connection with certain specific embodiments thereof, it is to be understood that this is by way of illustration and not of limitation. Reasonable variation and modification are possible within the scope of the forgoing disclosure and drawings without departing from the spirit of the disclosure which is defined in the appended claims.

This written description uses examples to disclose embodiments of the invention, and also to enable any person skilled in the art to practice embodiments of the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A household appliance, comprising:

a cabinet having an access opening;

a treating chamber within the cabinet and configured to receive an article for treatment according to a cycle of operation of the household appliance;

a transparent window coupled with the cabinet aligned with the access opening and providing visual access to the treating chamber from outside the cabinet; and a coating on at least a portion of the treating chamber, the coating configured to provide at least hydrophobicity characteristics and reversible thermochromic characteristics to the at least a portion of the treating chamber, wherein the coating is configured to provide visual indication through the transparent window of a surface temperature of the at least the portion of the treating chamber;

wherein the coating comprises a composite including carbon nanotubes and vanadium dioxide nanowires; and wherein the visual indication comprises a color change configured to indicate at least one of the surface temperature in the treating chamber being within a desired temperature range, the surface temperature in the treating chamber exceeding a desired temperature range, a non-uniform temperature distribution within the treating chamber, or the surface temperature in the treating chamber changing over time.

2. The household appliance of claim 1 wherein the hydrophobicity characteristics comprise a sliding angle of at least 2 degrees and a droplet contact angle of at least 145 degrees.

3. The household appliance of claim 1 wherein the coating is a thin film coating less than 700 micrometers thick.

4. The household appliance of claim 1 wherein the carbon nanotubes include either single-walled carbon nanotubes or multi-walled carbon nanotubes to define carbon nanotubes.

5. The household appliance of claim 1 wherein the vanadium dioxide nanowires have an average diameter of 65 nm-110 nm and a length of up to 4.5 micrometers, and the carbon nanotubes have an average diameter in the range of 2 nm-40 nm and a length of 0.1 nm-1 cm.

6. The household appliance of claim 1 wherein the coating has the color change between 30° C.-250° C.

7. The household appliance of claim 6 wherein the color change of the coating changes from yellow to orange.

8. The household appliance of claim 1 wherein the household appliance is a laundry treating appliance, comprising:

a drum having an inside surface defining an interior forming the treating chamber for holding the article;

a fluid delivery system in fluid communication with the interior of the drum; and a fluid removal system in fluid communication with the interior of the drum.

9. The household appliance of claim 8, further comprising a motor in driving engagement with the drum and configured to selectively rotate the drum and cause movement of the article within the drum.

10. The household appliance of claim 8, further comprising a treating chemistry dispenser in fluid communication with the interior of the drum.

11. The household appliance of claim 8 wherein the coating comprises the coating on at least one surface selected from a group consisting of: a front wall of the drum, a back wall of the drum, a circumferential wall of the drum, an interior surface of a closure for the drum, a baffle extending inwardly from the inside surface of the drum, and a depression in the inside surface of the drum.

12. The household appliance of claim 11 wherein the closure comprises at least one door selectively closing the access opening and having the transparent window.

13. The household appliance of claim 8 wherein the fluid delivery system comprises at least one of a water supply, an air supply, a sprayer, an injector, a nebulizer, a pump, a steam generator, a fan, or a heater.

14. The household appliance of claim 8 wherein the fluid removal system comprises at least one of: a liquid pump, a vacuum system, a heater, a fan, an air compressor, an air source, an air tank, an air pump, a condenser system, a desiccant system, a steam drying system, an electrostatic drying system, a microwave drying system, a conduction drying system, or a convection drying system.

15. A household appliance, comprising:

a cabinet having an access opening;

a treating chamber within the cabinet and configured to receive an article for treatment according to a cycle of operation of the household appliance;

a transparent window coupled with the cabinet aligned with the access opening and providing visual access to the treating chamber from outside the cabinet; and a composite coating on a portion of the treating chamber and comprising carbon nanotubes configured to provide hydrophobic characteristics to the portion of the treating chamber, and also comprising vanadium dioxide nanowires configured to provide reversible thermochromic visual indication of a surface temperature of the portion of the treating chamber through the transparent window;

wherein the composite coating comprises a coating thickness between 700 micrometers and 2 mm; and wherein the reversible thermochromic visual indication comprises a color change configured to indicate at least one of the surface temperature in the treating chamber being within a desired temperature range, the surface temperature in the treating chamber exceeding a desired temperature range, a non-uniform temperature distribution within the treating chamber, or the surface temperature in the treating chamber changing over time.

16. The household appliance of claim 15 wherein the carbon nanotubes include either single-walled carbon nanotubes or multi-walled carbon nanotubes to define carbon nanotubes.

17. The household appliance of claim 15 wherein the hydrophobic characteristics comprise a droplet contact angle of at least 145 degrees.

18. A laundry treating appliance, comprising:

a cabinet having an access opening;

a treating chamber within the cabinet and configured to receive an article for treatment according to a cycle of operation of the laundry treating appliance;

a transparent window coupled with the cabinet aligned with the access opening and providing visual access to the treating chamber from outside the cabinet; and a composite coating on a portion of the treating chamber and comprising carbon nanotubes configured to provide hydrophobic characteristics to the portion of the treating chamber, and also comprising vanadium dioxide nanowires configured to provide reversible thermochromic visual indication of a surface temperature of the portion of the treating chamber through the transparent window during the cycle of operation;

wherein the vanadium dioxide nanowires have an average diameter of 65 nm-110 nm and a length of up to 4.5 micrometers, and wherein the carbon nanotubes have an average diameter in the range of 2 nm-40 nm and a length of 0.1 nm-1 cm; and wherein the reversible thermochromic visual indication comprises a color change configured to indicate at least one of the surface temperature in the treating chamber being within a desired temperature range, the surface temperature in the treating chamber exceeding a desired temperature range, a non-uniform temperature distribution within the treating chamber, or the surface temperature in the treating chamber changing over time.

19. The laundry treating appliance of claim 18 wherein the carbon nanotubes include either single-walled carbon nanotubes or multi-walled carbon nanotubes to define carbon nanotubes.

20. The laundry treating appliance of claim 18 wherein the reversible thermochromic visual indication comprises the color change between 30° C.-250° C.

* * * * *